US009580263B2

(12) United States Patent
Park et al.

(10) Patent No.: US 9,580,263 B2
(45) Date of Patent: Feb. 28, 2017

(54) APPARATUS FOR AUTOMATICALLY ALIGNING BILL AND SKEW CONTROL UNIT

(71) Applicant: Nautilus Hyosung Inc., Seoul (KR)

(72) Inventors: Jong Seong Park, Anyang-si (KR); Kyoung Sik Kim, Seoul (KR); Jun Young Kim, Gyeonggi-do (KR); Chang Ho Park, Gunpo-si (KR); Young Chul Lee, Yongin-si (KR); Jin Young Hwang, Seoul (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 14/875,887

(22) Filed: Oct. 6, 2015

(65) Prior Publication Data

US 2016/0101958 A1 Apr. 14, 2016

(30) Foreign Application Priority Data

Oct. 8, 2014 (KR) ..... 10-2014-0135713

(51) Int. Cl.

| | |
|---|---|
| ***B65H 9/16*** | (2006.01) |
| ***B65H 5/06*** | (2006.01) |
| ***B65H 9/00*** | (2006.01) |
| ***B65H 9/10*** | (2006.01) |

(52) U.S. Cl.

CPC ..... *B65H 9/002* (2013.01); *B65H 5/062* (2013.01); *B65H 9/106* (2013.01); *B65H 9/166* (2013.01)

(58) Field of Classification Search

CPC ..... B65H 9/166; B65H 9/106; B65H 5/062; B65H 2403/43; B65H 5/068

See application file for complete search history.

(56) References Cited

U.S. PATENT DOCUMENTS

| | | | | |
|---|---|---|---|---|
| 4,669,718 A * | 6/1987 | Rovin | ..... | B65H 9/002 226/21 |
| 6,053,494 A * | 4/2000 | Baskette | ..... | B65H 33/06 271/251 |
| 6,581,929 B2 * | 6/2003 | Hiramitsu | ..... | B65H 9/002 271/225 |

(Continued)

FOREIGN PATENT DOCUMENTS

| | | |
|---|---|---|
| JP | 2002-312828 A | 10/2002 |
| KR | 10-2007-0079669 A | 8/2007 |

(Continued)

OTHER PUBLICATIONS

Korean Office Action Dated Mar. 15, 2016 in Corresponding Application No. 10-2014-0135713.

*Primary Examiner* — Luis A Gonzalez

(74) *Attorney, Agent, or Firm* — Bacon & Thomas, PLLC

(57) ABSTRACT

An apparatus for automatically aligning bills includes: a plurality of skew control units including a driving roller unit, a body, a first gear unit, and a second gear unit; a first motor unit connected with the first gear unit through a first power transmission member and providing a driving force to the driving roller unit; a second motor unit connected with the second gear unit through a second power transmission member and providing torque to the body; and ball caster units having a spherical shape and coming in contact with a second side of the bill.

8 Claims, 9 Drawing Sheets

(56) References Cited

U.S. PATENT DOCUMENTS

| | | | | |
|---|---|---|---|---|
| 7,319,842 | B2 * | 1/2008 | Koyanagi | B65H 7/10 271/226 |
| 8,348,267 | B2 * | 1/2013 | Storey | B65H 5/062 271/228 |
| 2007/0181668 | A1 | 8/2007 | Kwak et al. | |
| 2013/0306436 | A1 | 11/2013 | Lee | |

FOREIGN PATENT DOCUMENTS

| | | | |
|---|---|---|---|
| KR | 10-2013-0127661 | A | 11/2013 |
| KR | 10-2014-0084742 | A | 7/2014 |

* cited by examiner

APPARATUS FOR AUTOMATICALLY ALIGNING BILL AND SKEW CONTROL UNIT

CROSS REFERENCE TO RELATED APPLICATION

The present application claims priority to Korean Patent Application No. 10-2014-135713, filed Oct. 8, 2014, the entire contents of which is incorporated herein for all purposes by this reference.

FIELD OF THE INVENTION

The present invention relates to an apparatus for automatically aligning bills and a skew control unit. More particularly, the present invention relates to an apparatus for automatically aligning bills that automatically aligns bills by correcting skew of the bills while the bills are conveyed in an automatic bill receiving and processing machine, and a skew control unit that controls skew of bills in the apparatus for automatically aligning bills.

BACKGROUND OF THE INVENTION

In general, an ATM (Automatic Teller Machine) is an automatic machine that can provide financial services for users to deposit/withdraw cash and checks using cards or bankbooks without a teller and without time and place limitations.

Recently, ATMs have been increasingly used not only at financial institutions including banks, but convenience stores, department stores, and public places. ATMs can be classified into a paying machine, a receiving machine, and a paying/receiving machine, and ATMs are recently used for various uses such as receiving/paying checks, bankbook updating, giro payment, and ticketing, in addition to paying/receiving cash.

In the ATMs, there is a machine that receives and automatically processes bills such as cash and checks. An automatic bill receiving and processing machine ascertains genuineness of received bills and processes normal bills, and when a bill is put into the machine through a slot from the outside, the machine acquires information about bills, for example, by scanning the bill while conveying the bill. Further, the machine ascertains genuineness of the bill on the basis of the acquired information, and it finally receives the bill when there is no problem, but it returns the bill when there is a problem.

Accordingly, a bill is supposed to be aligned and sent to the exact position where a scanner is located when it is scanned to acquire information, but a bill may be moved at an angle (hereafter, referred to as "skew") not in an accurate posture while it is conveyed, so it may be difficult to acquire information.

SUMMARY OF THE INVENTION

It is, therefore, an object of the present invention to provide an apparatus for automatically aligning bills that automatically aligns bills by correcting skew of the bills when the bills are skewed in the process of conveying the bills in an automatic bill receiving and processing machine.

Another object of the present invention is to provide an apparatus for automatically aligning bills that has simple configuration and structure for correcting skew of bills, has high durability, and is manufactured at a low cost.

Another object of the present invention is to provide a skew control unit that corrects skew of bills in an apparatus for automatically aligning bills so that the bills can be aligned.

In accordance with a preferred embodiment of the present invention, there is provided an apparatus for automatically aligning bills that includes: a plurality of skew control units including a driving roller unit moving a bill in contact with a first side of the bill, a body rotatably supporting the driving roller unit and being rotatable about a rotary shaft to change a conveying direction of the bill, a first gear unit disposed on a first side of the body and providing a driving force to the driving roller unit, and a second gear unit disposed on a second side of the body and correcting skew of the bill by rotating the body; a first motor unit connected with the first gear unit through a first power transmission member and providing a driving force to the driving roller unit; a second motor unit connected with the second gear unit through a second power transmission member and providing torque to the body; and ball caster units having a spherical shape and coming in contact with a second side of the bill.

The first gear unit may include: a main gear receiving a driving force from the first power transmission member; a bevel ring gear integrally coupled to a top of the main gear; and a bevel pinion gear engaged with a side of the bevel ring gear, receiving torque from the bevel ring gear, disposed on a same shaft with the driving roller unit, and rotating the driving roller unit.

A bearing may be disposed between the first gear unit and the first side of the body.

The first motor unit may provide a driving force to a first driving shaft through a first bevel gear, and a first driving gear unit connected with the first power transmission member may be disposed on the first driving shaft.

The second motor unit may provides a driving force to a second driving shaft through a second bevel gear, and a second driving gear unit connected with the second power transmission member is disposed on the second driving shaft.

The first power transmission member and the second power transmission members may be timing belts.

A tensioner for maintaining tension may be disposed on the first power transmission member and the second power transmission member.

The ball caster units each may include: a spherical ball; and a housing holding the ball by covering a portion of the ball so that the ball makes a spherical motion at the position separation.

The ball caster units each may further include an elastic member for pushing the ball to the driving roller unit to increase a force for holding the bill.

In accordance with another preferred embodiment of the present invention, there is provided a skew control unit that includes: a driving roller unit moving a bill in contact with a first side of the bill; a body rotatably supporting the driving roller unit and being rotatable about a rotary shaft to change a conveying direction of the bill when the bill is skewed; a first gear unit disposed on a first side of the body and providing a driving force to the driving roller unit; and a second gear unit disposed on a second side of the body and correcting skew of the bill by rotating the body.

The first gear unit may include: a main gear receiving a driving force from the first power transmission member; a bevel ring gear integrally coupled to a top of the main gear; and a bevel pinion gear engaged with a side of the bevel ring gear, receiving torque from the bevel ring gear, disposed on a same shaft with the driving roller unit, and rotating the driving roller unit.

A bearing may be disposed between the first gear unit and the first side of the body.

According to an embodiment of the present invention, it is possible to provide an apparatus for automatically aligning bills that automatically aligns bills by quickly and accurately correcting skew of the bills when the bills skewed in the process of conveying the bills in an automatic bill receiving and processing machine.

According to another embodiment of the present invention, since when the angle of the driving roller unit is changed to correct skew of a bill, the ball caster units can be freely changed in rotational direction in response to the angle of the driving roller unit without specific power from the outside or a specific angle changing unit, thus it is possible to simplify the structure of the apparatus for automatically aligning bills, improve the durability, and reduce the manufacturing cost.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
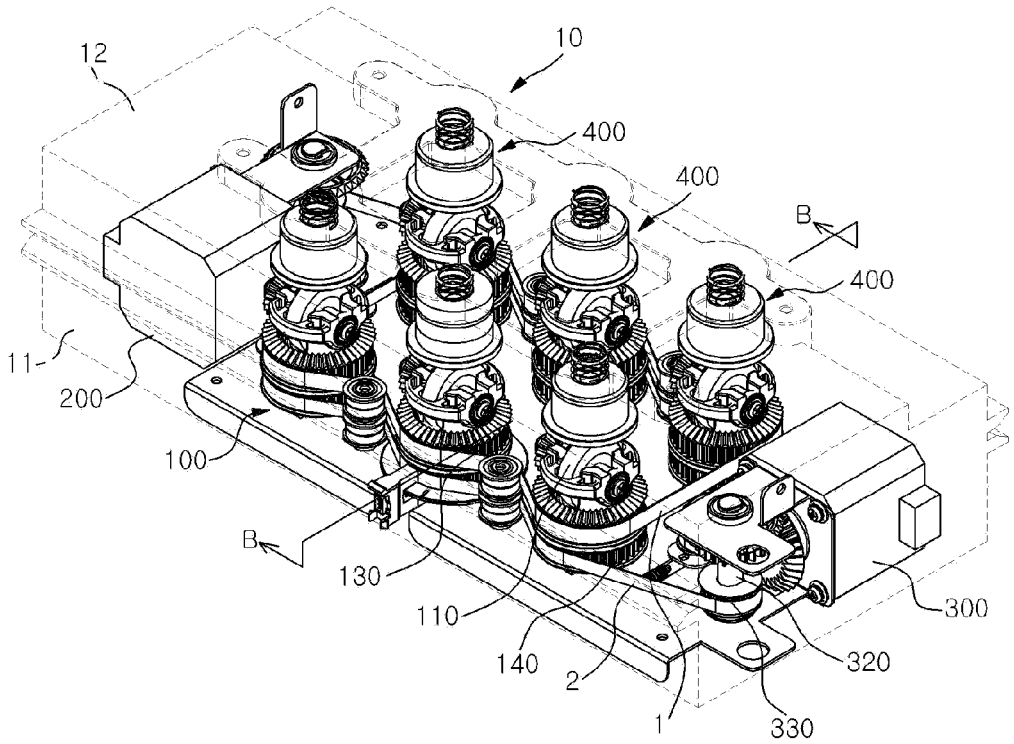
FIG. 1 is a partial perspective view showing an apparatus for automatically aligning bills according to an embodiment of the present invention.

Hereinafter, configuration and operation of embodiments of the present invention will be described in detail with reference to the accompanying drawings. The following description is one of various aspects of the present invention that can be claimed for patent and may be a portion of detailed description of the present invention.

In the following description, however, well-known configuration or function may not be described in detail for making the present invention clear.

The present invention may be modified in various ways and implemented by various exemplary embodiments, so that specific exemplary embodiments are illustrated in the drawings and will be described in detail below. However, it is to be understood that the present invention is not limited to the specific exemplary embodiments, but includes all modifications, equivalents, and substitutions included in the spirit and the scope of the present invention.

Terms including ordinal numerals such as 'first' and 'second' may be used for indicating various components, but those components are not limited to the terms. The terms are used to distinguish one component from another component.

Terms used in the present specification are used only in order to describe specific exemplary embodiments rather than limiting the present invention. As used herein, the singular forms are intended to include the plural forms as well, unless the context clearly indicates otherwise.

An apparatus 10 for automatically aligning bills according to an embodiment of the present invention is described hereafter with reference to the accompanying drawings.

Figure 2:
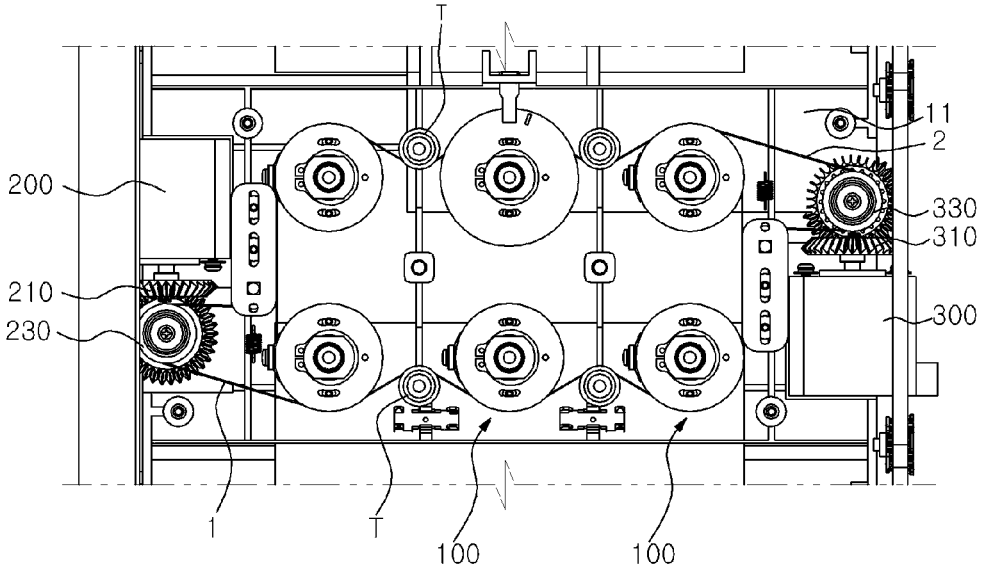
FIG. 2 is a bottom view of FIG. 1.

FIG. 1 is a partial perspective view showing an apparatus 10 for automatically aligning bills according to an embodiment of the present invention and FIG. 2 is a bottom view of FIG. 1.

Referring to FIGS. 1 and 2, an apparatus 10 for automatically aligning bills according to an embodiment of the present invention may include a plurality of skew control units 100, a first motor unit 200, a second motor unit 300, and ball caster units 400.

The apparatus 10 for automatically aligning bills according to an embodiment of the present invention shown in FIG. 1 can detect skew of a bill (movement at an angle of a bill) and align the bill so that the bill can be normally conveyed while the bill is conveyed from a place to another place. Detecting skew of a bill and transmitting a predetermined control signal are well known in the art, so a detailed description is not provided.

The apparatus 10 for automatically aligning bills may include a lower frame 11 and an upper frame 12 that are disposed under and over a bill conveying path, respectively, in which the skew control unit 100, the first motor unit 200, and the second motor unit 300 may be disposed on the lower frame 11 and the ball caster units 400 may be disposed on the upper frame 12.

Accordingly, when a bill conveyed between the lower frame 11 and the upper frame 12 is skewed, the skew control unit 100 and the ball caster units 400 are operated to correct the bill, so the bill can be aligned.

As shown in FIG. 2, at least two or more skew control units 100 may be disposed on the lower frame 11, at the middle area of the bill conveying path.

The skew control unit 100 is described in detail hereafter.

Figure 3:
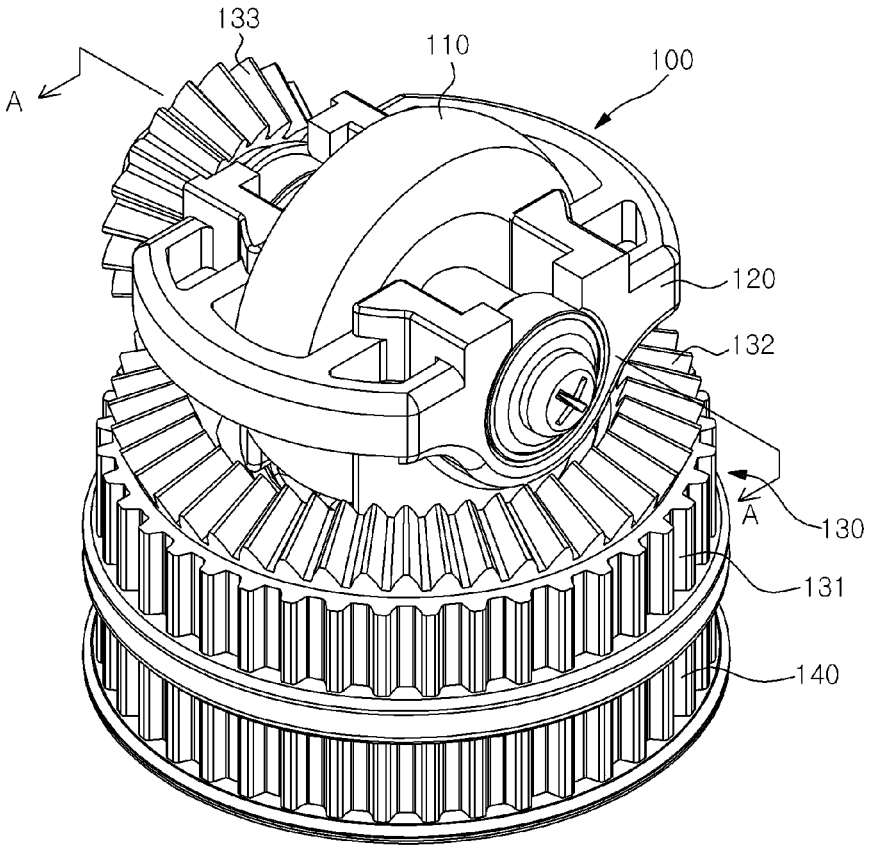
FIG. 3 is a perspective view showing a skew control unit according to an embodiment of the present invention.
Figure 4:
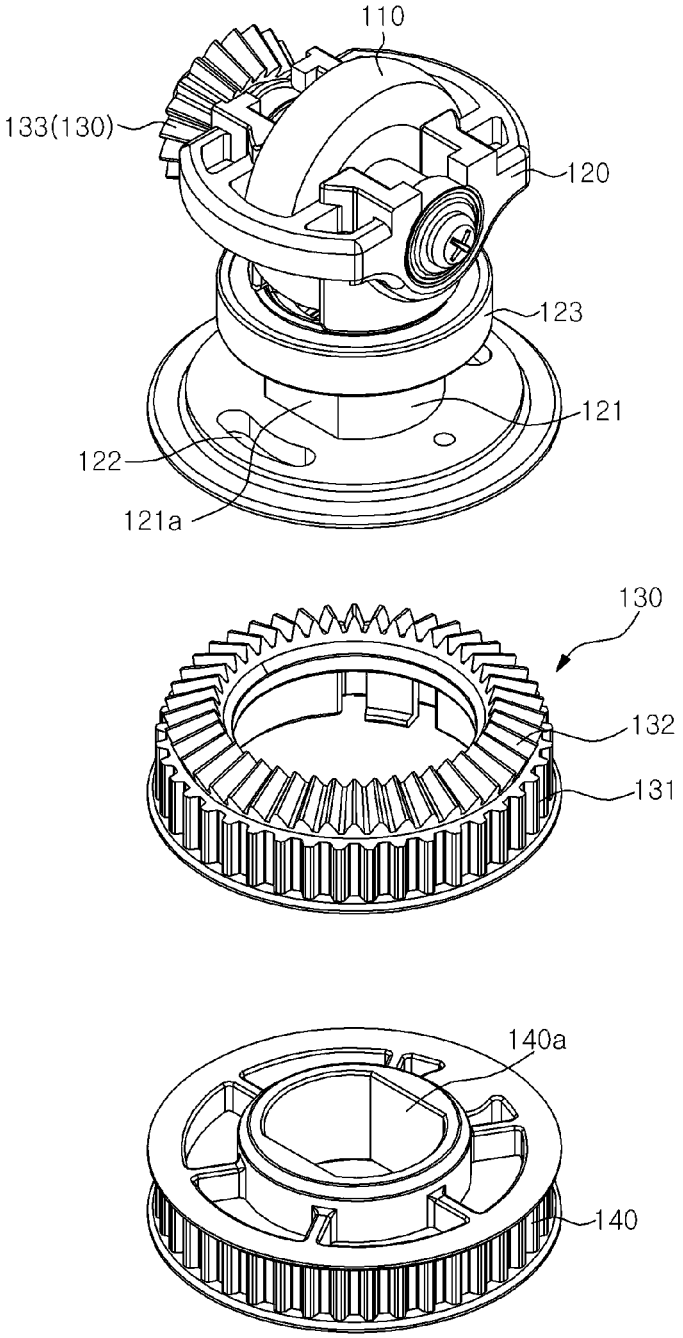
FIG. 4 is an exploded view of FIG. 3.
Figure 5:
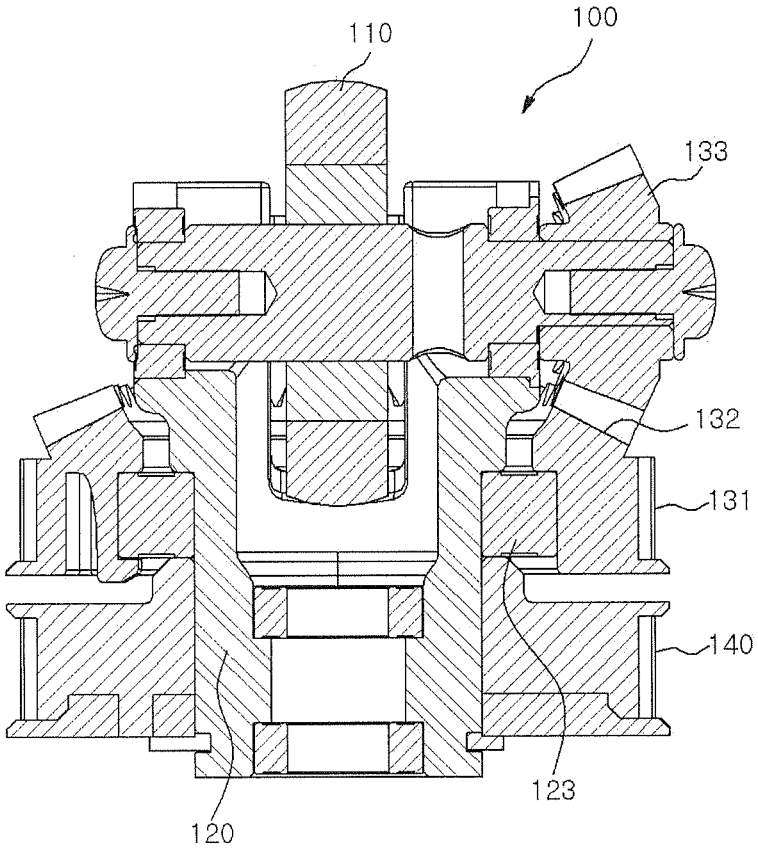
FIG. 5 is a cross-sectional view taken along line A-A of FIG. 3.

FIG. 3 is a perspective view showing the skew control unit 100 according to the present embodiment, FIG. 4 is an exploded perspective view of FIG. 3, and FIG. 5 is a cross-sectional view taken along line A-A of FIG. 5.

Referring to FIGS. 3 to 5, the skew control unit 100 may include a driving roller unit 110, a body 120, a first gear unit 130, and a second gear unit 140.

The driving roller unit 110 can move a bill in contact with a side (for example, the bottom) of the bill. The driving roller unit 110 is disposed on the lower frame 11 and driven by force from the outside (for example, a power transmission member), and the upper portion of the driving roller unit 110 may partially protrude to the conveying path of a bill (that is, over the lower frame 11).

The driving roller unit 110 is rotatably mounted on the body 120. The body 120 may be rotated about a rotary shaft 121 on the lower frame 11 to align a bill by correcting skew of the bill. Oblong holes 122 are formed at a side of the body 120 and fastening members (not shown) such as a bolt are inserted in the oblong holes 122, thereby fastening the body 120 to the lower frame 11. Accordingly, the body 120 can be rotated (adjusted in angle) by the length of the oblong holes 122 on the lower frame 11.

The first gear unit 130 is disposed on a side of the body 120 and can provide a driving force to the driving roller unit 110. The first gear unit 130 is rotated independently from the rotary shaft 121 of the body 120 and a bearing 123 may be disposed between the first gear unit 130 and a side of the body 120 so that torque from the first gear unit 130 is not transmitted to the body 120.

The first gear unit 130 may include a main gear 131, a bevel ring gear 132, and a bevel pinion gear 133.

The main gear 131 can be rotated by a driving force transmitted through a power transmission member (for convenience, referred to as a 'first power transmission member 1') such as a chain or a belt. Even though the main gear 131 is rotated, the body 120 is not rotated.

The bevel ring gear 132 may be integrally coupled to the top of the main gear 131. When the main gear 131 is rotated, the bevel ring gear 132 can be rotated accordingly.

The bevel pinion gear 133 is engaged with a side of the bevel ring gear 132 and receives torque from the bevel ring gear 132. Further, the bevel pinion gear 133 is connected to the driving roller unit 110 through the same shaft, so it can rotate the driving roller unit 110.

Accordingly, when the first gear unit 130 is rotated, the driving roller unit 110 is rotated in the driving direction, so a bill can be moved.

The second gear unit 140 is disposed on the other side of the body 120 and can correct skew of a bill by changing the angle of the driving roller unit 110 by rotating the body 120 about the rotary shaft 121.

The second gear unit 140 can be rotated by another power transmission member (for convenience, referred to as a 'second power transmission member 2') and torque from the second gear unit 140 is supposed to be transmitted to the body 120, so the second gear unit 140, as shown in FIG. 4, may be fitted on the rotary shaft 121 of the body 120.

At least one or more flat surfaces 121*a* and 140*a* may be formed on the contact surfaces between the second gear unit 140 and the rotary shaft 121 so that torque can be easily transmitted without slip between the second gear unit 140 and the body 120.

Figure 6:
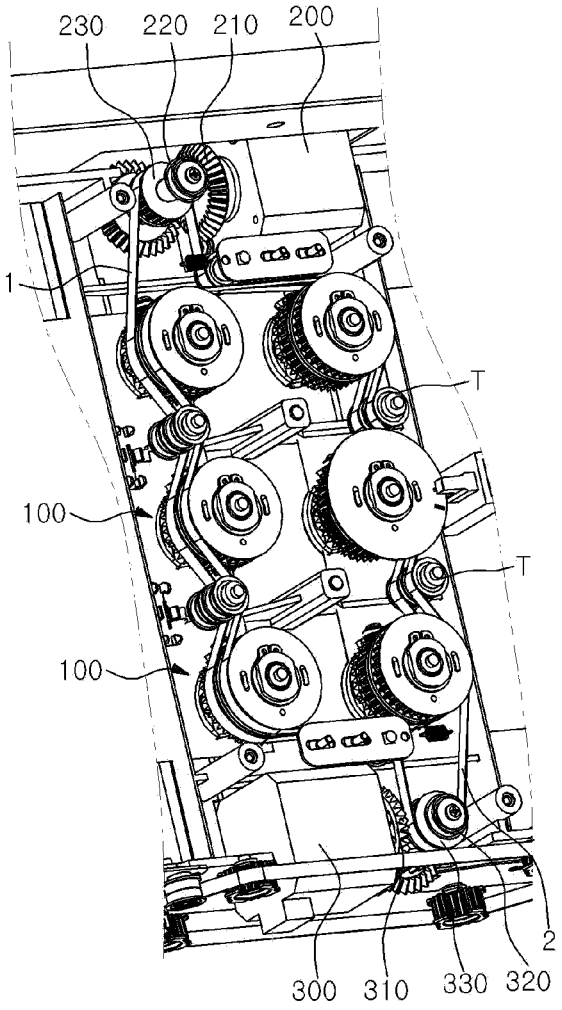
FIG. 6 is a perspective view showing the bottom of FIG. 1.

The first motor unit 200, the second motor unit 300, and a relevant configuration are described hereafter with reference to FIGS. 2 and 6.

FIG. 2 is a bottom view of FIG. 1 and FIG. 6 is a perspective bottom view of FIG. 1. As shown in the figures, the first motor unit 200 is connected to the first gear units 130 of the skew control units 100 through the first power transmission member 1, so it can provide a driving force to the driving roller units 110 of the skew control units 100.

The first motor unit 200 can provide a driving force to the first driving shaft 110 through the first bevel gear 210 and a first driving gear unit 230 connected with the first power transmission member 1 may be disposed on the first driving shaft 220. The first power transmission member 1 may be connected with the first driving gear unit 230 and the first gear units 130 in the type of an endless track.

The second motor unit 300 is connected to the second gear units 140 of the skew control units 100 through the second power transmission member 2, so it can transmit torque to the body 120. As described above, when the body 120 is rotated, skew of a bill can be corrected.

The second motor unit 300 can provide a driving force to the second driving shaft 320 through the second bevel gear 310 and a second driving gear unit 330 connected with the second power transmission member 2 may be disposed on the second driving shaft 320. The second power transmission member 2 may also be connected with the second driving gear unit 330 and the second gear units 130 in the type of an endless track.

The first motor unit 200 may be independently operated, or the first motor unit 200 and the second motor unit 300 may be simultaneously operated. The first motor unit 200 and the second motor unit 300 may be bidirectional motors that can rotate both forward and backward.

The first power transmission member 1 and the second power transmission member 2 may be timing belts to prevent slip on the first and second gear units 130 and 140, respectively. The first and second gear units 130 and 140 are supposed to in the same direction at the same angle and slip generated in the process of transmitting power cannot be precisely controlled, so timing belts may be efficient.

A tensioner T for maintaining tension of a power transmission member may be disposed on the first power transmission member 1 and the second power transmission member 2. The tensioners T can maintain optimum tension by pushing the first and second power transmission members 1 and 2 with an appropriate force. The tensioners T may be members that are rotated by a power transmission member.

Figure 7:
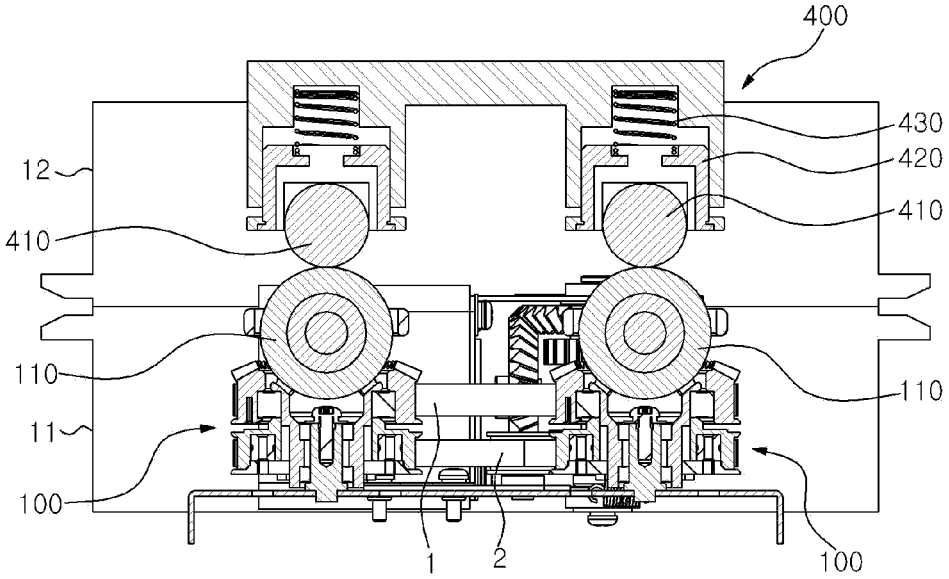
FIG. 7 is a cross-sectional view taken along the line B-B of FIG. 1.

The ball caster unit 400 is described hereafter with reference to FIG. 7.

FIG. 7 is a cross-sectional view taken along the line B-B of FIG. 1. As shown in FIG. 7, the ball caster unit 400 is formed in a spherical shape, comes in contact with a second side (for example, the top) of a bill 'p', and makes a spherical motion at the position when a bill is conveyed. The ball caster unit 400 is disposed on the upper frame 12 and may be circumscribed on the driving roller unit 110.

The driving roller unit 110 is rotated by a driving force from the outside, but the ball caster unit 400 can be rotated at the position without a specific driving unit in contact with a conveyed bill or the driving roller unit 110.

Since the ball caster unit 400 is formed in a spherical shape, the rotational direction is not specifically defined and it can idle in all directions at the position in accordance with the direction of a force from the outside.

Accordingly, when the angle of the driving roller unit 110 is changed to correct skew of a bill, the ball caster unit 400 can freely change the rotational direction in response to the angle of the driving roller unit 110 without specific power from the outside or an angle changing unit. Accordingly, the structure of the apparatus 10 for automatically aligning bills is simplified, durability is improved, and manufacturing cost is reduced.

The ball caster unit 400 may include a ball 410 and a housing 420, and may further include an elastic member 430.

The ball 410 has a spherical shape and can make a spherical motion at the position in contact with a bill or the driving roller unit 110.

The housing 420 can hold the ball 410 by covering a portion of the ball 410 so that the ball 410 can make spherical motion without separation. The housing 420 may cover at least a half or more of the ball 410 to prevent separation of the ball 410.

The ball caster unit 400 may further include an elastic member 430 pushing the ball 410 to the driving roller unit 110 to increase the force for holding a bill. Even if the elastic member 430 is not provided, a predetermined force is applied to the driving roller unit 110 by the weight of the ball 410 and the housing 420, so the holding force is generated, but it is preferable to apply an elastic force using the elastic member 430 in order to smoothly and quickly convey a bill and increase the holding force.

Figure 8:
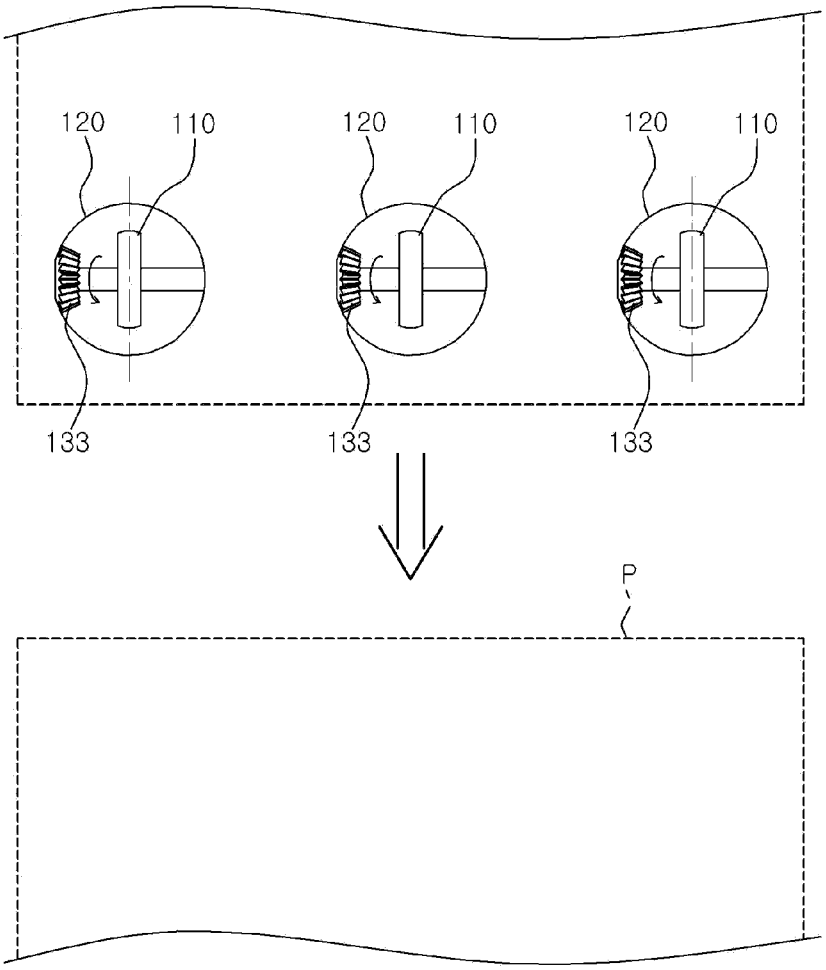
FIGS. 8 and 9 are view showing operation of the skew control unit according to an embodiment of the present invention.
Figure 9:
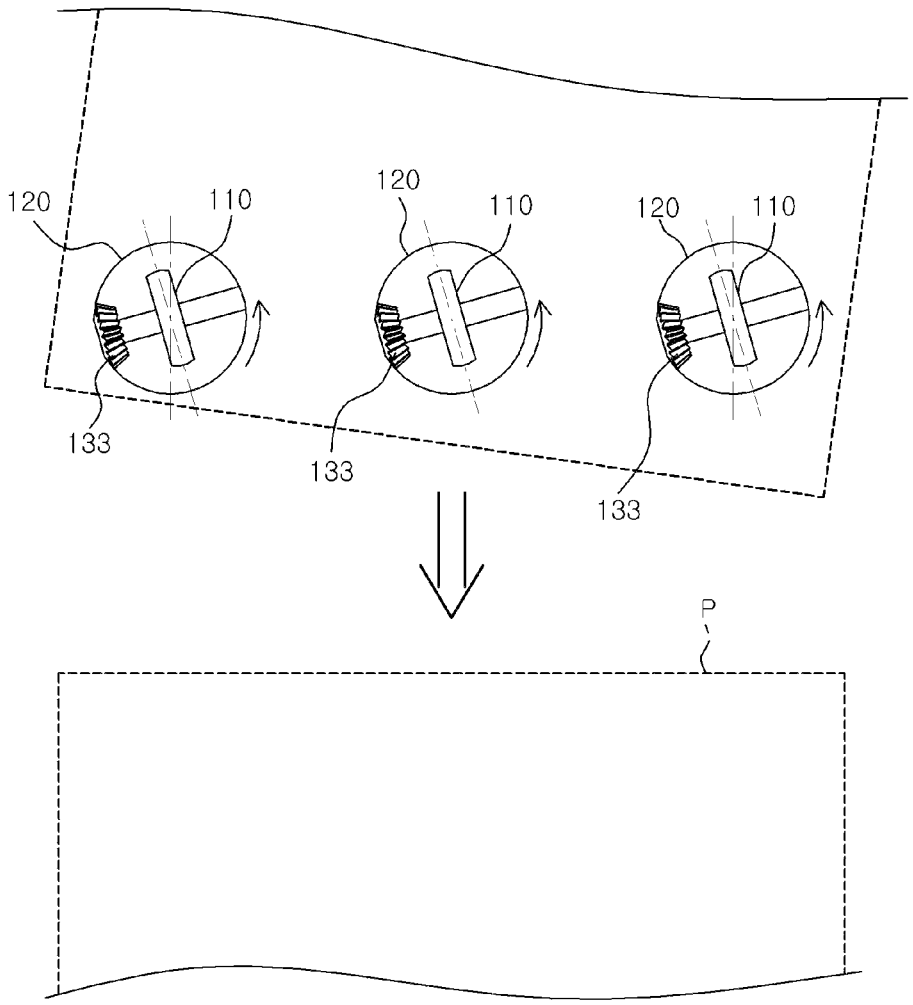

Operation of the present embodiment is briefly described hereafter with reference to FIGS. 8 and 9.

FIGS. 8 and 9 are plan views schematically showing the driving roller unit 110 of the skew control unit 100, but the detailed operation of most components were described above, so the operation for correcting skew of a bill is described hereafter.

When a bill 'p' is conveyed, the driving roller unit 110 is rotated by the operation of the first motor unit 200, the first power transmission member 1, and the first gear unit 130, thereby sending the pill along a predetermined path.

When the bill is normally moved without skew, as shown in FIG. 8, the angle of the body 120 is not chanted and the driving direction of the driving roller unit 110 is the same as the conveying direction of the bill.

However, when a bill is skewed, as shown in FIG. 9, the driving roller unit 110 keeps operating and the body 120 is rotated at a predetermined angle by the second motor unit 300, the second power transmission member 2, and the second gear unit 140. As the body 120 is rotated and changed in angle, the driving direction of the driving roller unit 110 makes a predetermined angle with respect to the conveying direction of the bill, so the skew of the bill is gradually corrected.

With the change in driving direction (angle) of the driving roller unit 110, the conveying direction of the bill is also changed, so the ball caster unit 400 can be freely changed in rotational direction by a friction force on the bill without power from the outside.

While the invention has been shown and described with respect to the preferred embodiments, it will be understood by those skilled in the art that various changes and modifications may be made without departing from the spirit and scope of the invention as defined in the following claims.

What is claimed is:

1. An apparatus for automatically aligning bills, comprising:

a plurality of skew control units including a driving roller unit moving a bill in contact with a first side of the bill, a body rotatably supporting the driving roller unit and being rotatable about a rotary shaft to change a conveying direction of the bill, a first gear unit disposed on a first side of the body and providing a driving force to the driving roller unit, and a second gear unit disposed on a second side of the body and correcting skew of the bill by rotating the body;

a first motor unit connected with the first gear unit through a first power transmission member and providing a driving force to the driving roller unit;

a second motor unit connected with the second gear unit through a second power transmission member and providing torque to the body; and ball caster units having a spherical shape and coming in contact with a second side of the bill wherein the first motor unit provides a driving force to a first driving shaft through a first bevel gear, and wherein a first driving gear unit connected with the first power transmission member is disposed on the first driving shaft.

2. The apparatus of claim 1, wherein the first gear unit includes:

a main gear receiving a driving force from the first power transmission member;

a bevel ring gear integrally coupled to a top of the main gear; and a bevel pinion gear engaged with a side of the bevel ring gear, receiving torque from the bevel ring gear, disposed on a same shaft with the driving roller unit, and rotating the driving roller unit.

3. The apparatus of claim 1, wherein a bearing is disposed between the first gear unit and the first side of the body.

4. The apparatus of claim 1, wherein the second motor unit provides a driving force to a second driving shaft through a second bevel gear, and a second driving gear unit connected with the second power transmission member is disposed on the second driving shaft.

5. The apparatus of claim 1, wherein the first power transmission member and the second power transmission members are timing belts.

6. The apparatus of claim 5, wherein a tensioner for maintaining tension is disposed on the first power transmission member and the second power transmission member.

7. The apparatus of claim 1, wherein the ball caster units each include:

a spherical ball; and a housing holding the ball by covering a portion of the ball so that the ball makes a spherical motion at a predetermined position without separation.

8. The apparatus of claim 7, wherein the ball caster units each further include an elastic member for pushing the ball to the driving roller unit to increase a force for holding the bill.

* * * * *